US010648784B1

(12) United States Patent
Arnon

(10) Patent No.: US 10,648,784 B1
(45) Date of Patent: May 12, 2020

(54) AMMUNITION CASE MOUTH SEALING SYSTEM AND RELATED METHOD

(71) Applicant: Harry Arnon, Sanford, FL (US)

(72) Inventor: Harry Arnon, Sanford, FL (US)

( * ) Notice: Subject to any disclaimer, the term of this patent is extended or adjusted under 35 U.S.C. 154(b) by 0 days.

(21) Appl. No.: 16/056,951

(22) Filed: Aug. 7, 2018

Related U.S. Application Data

(60) Provisional application No. 62/541,980, filed on Aug. 7, 2017.

(51) Int. Cl.
*F42B 33/00* (2006.01)

(52) U.S. Cl.
CPC ..... *F42B 33/001* (2013.01)

(58) Field of Classification Search
CPC ..... F42B 33/001; F42B 33/14
USPC ..... 86/17, 18, 19.5, 19.7
See application file for complete search history.

(56) References Cited

U.S. PATENT DOCUMENTS 1,340,737 A * 5/1920 Paulson ..... F41A 9/83 86/47
3,091,153 A * 5/1963 Roper ..... F42B 33/12 86/17
2015/0107131 A1* 4/2015 Barnes ..... F26B 9/003 34/487
2016/0101443 A1* 4/2016 Christensen ..... B07B 1/22 134/95.2
2017/0370646 A1* 12/2017 Rettig ..... F26B 21/006

* cited by examiner

*Primary Examiner* — Joshua E Freeman
*Assistant Examiner* — Bridget A Cochran
(74) *Attorney, Agent, or Firm* — Allen Dyer Doppelt & Gilchrist, PA

(57) ABSTRACT

An ammunition sealing system includes a case hanging rail for holding a row of cases and one or more heating elements in close proximity to the row of cases. The one or more heating elements are configured to heat sealant applied inside the case mouths. The one or more heating elements are one or more induction heating elements or microwave heating elements.

11 Claims, 4 Drawing Sheets

AMMUNITION CASE MOUTH SEALING SYSTEM AND RELATED METHOD

CROSS-REFERENCE TO RELATED APPLICATION

This application claims the benefit of U.S. Provisional Patent Application Ser. No. 62/541,980, filed on Aug. 7, 2017, the contents of which application are herein incorporated by reference in their entirety.

FIELD OF THE INVENTION

The present invention relates to an improvement in ammunition sealing art, and more particularly, to an ammunition case mouth sealing system with induction heating and/or microwave heating.

BACKGROUND OF THE INVENTION

In ordinary ammunition manufacture, a projectile is sealed to a mouth of a casing after gun powder is loaded into the casing. A common method of sealing a projectile to an ammunition casing involves applying a liquid sealant to the mouth of the casing and then drying the applied sealant by one or more methods. Conventional blow-drying is time consuming and often noisy. The heating temperature is, moreover, difficult to control. While improvements have been made in the rate at which sealant can be dried, for instance, by using multiple high-powered heaters, the drying of sealant at the case mouth has remained a relatively slow batch process. Further improvements are possible.

SUMMARY OF THE INVENTION

In view of the foregoing, it is an object of the present invention to provide an ammunition case mouth sealing method and related methods of use. According to one embodiment of the present invention, an ammunition sealing system includes a case hanging rail for holding a row of cases and one or more heating elements in close proximity to the row of cases. The one or more heating elements are configured to heat sealant applied inside the case mouths. The one or more heating elements are one or more induction heating elements or microwave heating elements.

According to another embodiment of the present invention, a method of drying liquid sealant applied inside the mouths of ammunition cases in an ammunition assembly process comprises using a case hanging rail to hold a row of ammunition cases and positioning one or more heating elements in close proximity to the row of cases. Liquid sealant applied inside the case mouth is heated using the one or more heating elements. The one or more heating elements are one or more induction heating elements or microwave heating elements.

These and other objects, aspects and advantages of the present invention will be better appreciated in view of the drawings and following detailed description of preferred embodiments.

DETAILED DESCRIPTION OF PREFERRED EMBODIMENTS

Figure 1:
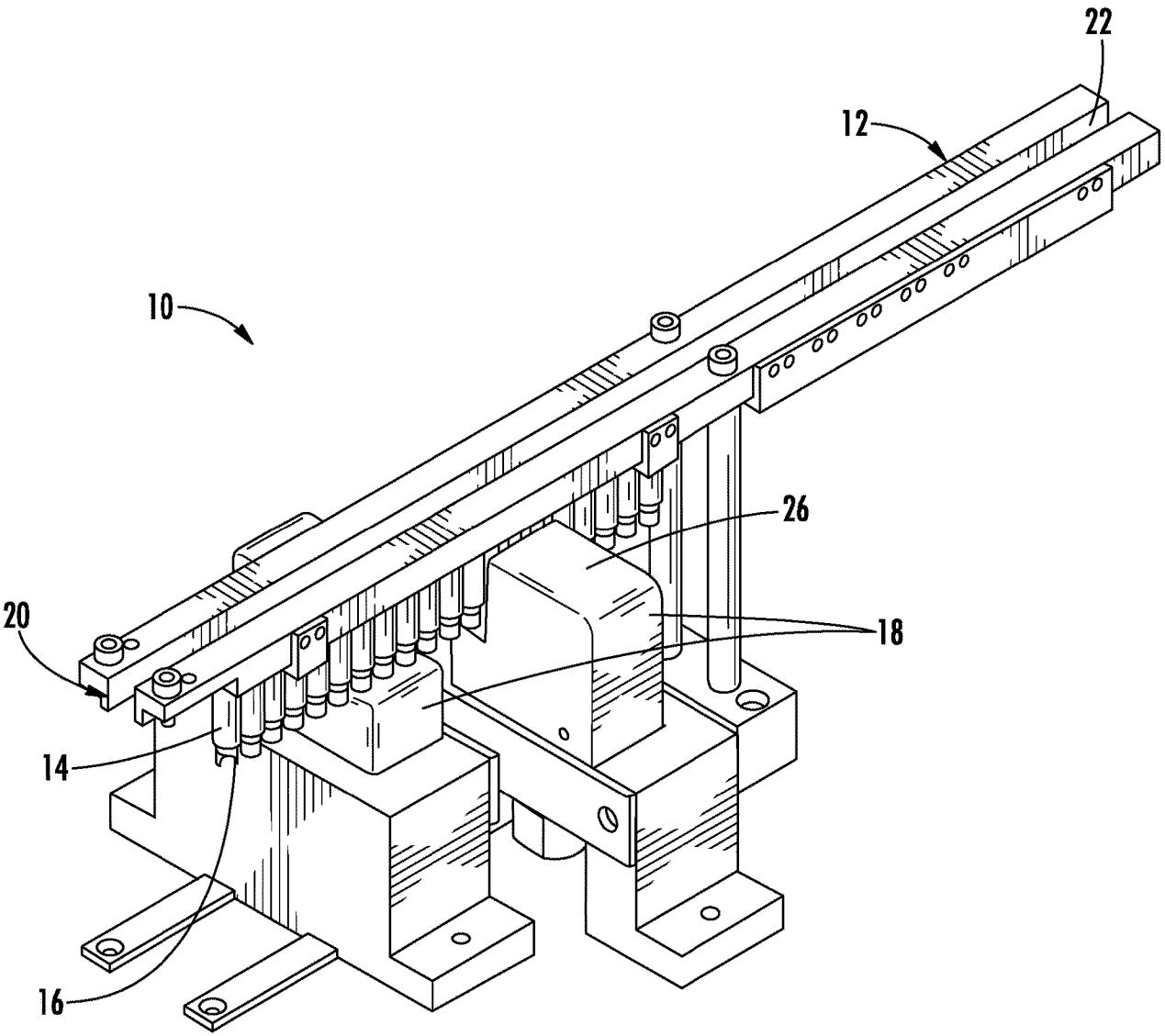
FIG. 1 is a perspective view of an ammunition case mouth sealing system according to an embodiment of the present invention.

According to an embodiment of the present invention, referring to FIG. 1, an ammunition sealing system 10 includes a case hanging rail 12 for holding a row of cases 14, and one or more heating elements 18 positioned in close proximity to the row of cases 14. In the depicted embodiment, two heating elements 18 are positioned underneath the case mouth 16 and in close proximity to both sides of case mouth to ensure efficient drying of the sealant. The dimension and position of the one or more heating elements 18 can vary with the size and number of rows of cases 14. After liquid sealant is dispensed inside the case mouth 16, the one or more heating elements 18 are used to heat the liquid sealant before a projectile is received into the case mouth 16. In the depicted embodiment, the row of cases 14 is shown with the case mouth 16 facing downwards. However, the row of cases 14 can be held in other suitable directions, such as with the case mouth 16 facing upwards.

In one embodiment, the one or more heating elements 18 can be an induction heating element. The one or more induction heating elements 18 includes an electromagnet and an electronic oscillator that passes a high-frequency alternating current through the electromagnet. The rapidly alternating magnetic field can penetrate the ammunition cases 14, inducing electric currents to flow through the cases 14 and thus heating the cases 14 by Joule heating.

The one or more heating elements 18 can further include a temperature sensor and controller 26 to adjust the heating temperature to a desired value. The temperature can be controlled by adjusting the level and/or frequency of the current through the electromagnet. The preferred heating temperature is usually below 140 degrees Fahrenheit.

The case hanging rail 12 can be configured to move the ammunition cases 14 along one direction of the rail 12 (e.g., from a first rail end 20 to a second rail end 22 or from the second rail end 22 to the first rail end 20) or both directions (e.g., from a first rail end 20 to a second rail end 22 and from the second rail end 22 to the first rail end 20) such that each case 14 will pass through the one or more heating elements 18 for the sealant to be heated and dried. Alternatively or additionally, the one or more heating elements 18 can be configured to move along one direction or both directions of the rail 12 to dry the row of cases 14 section by section.

Figure 2:
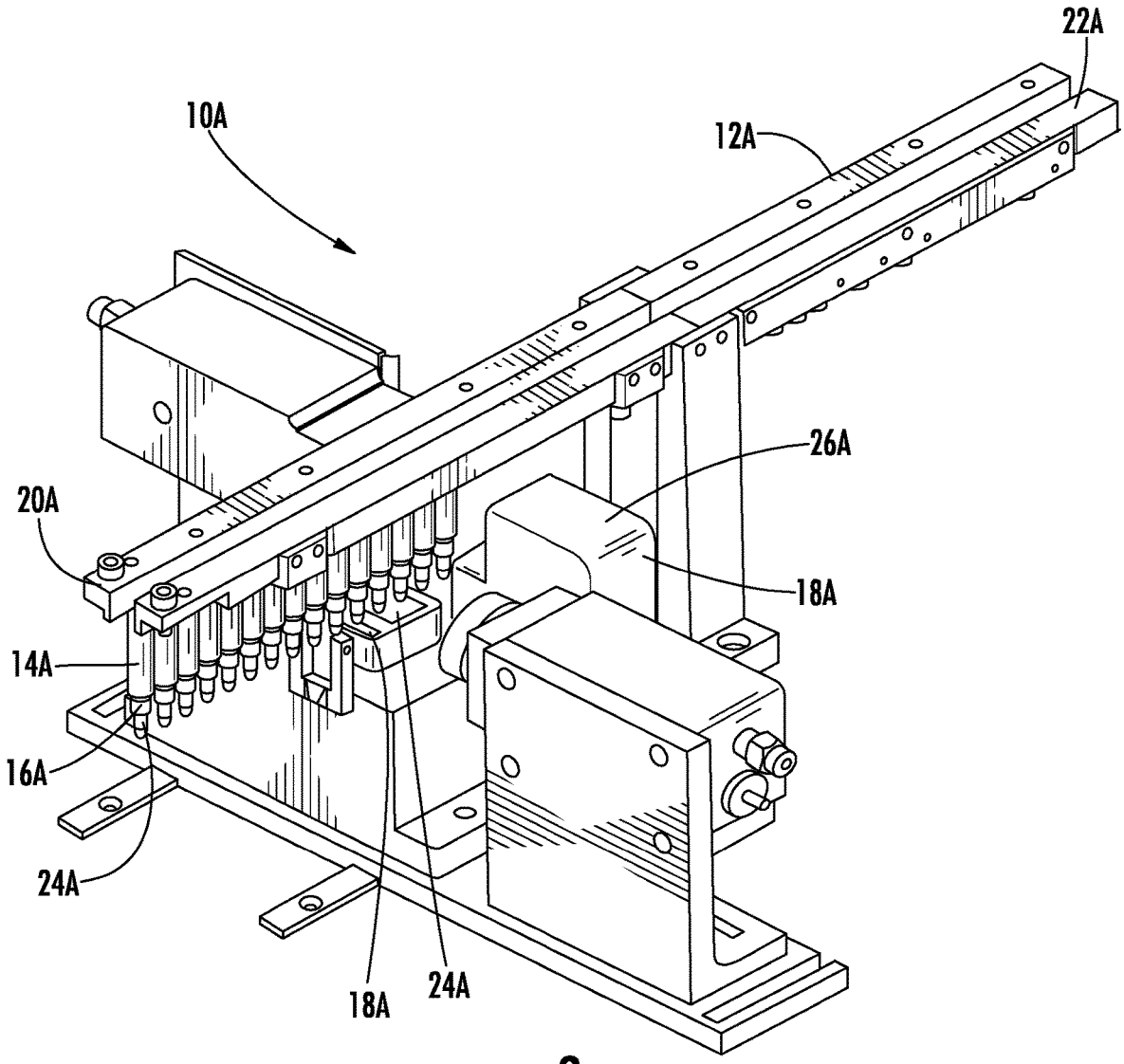
FIG. 2 is another perspective view of another ammunition case mouth sealing system, according to another embodiment of the present invention.

Referring to FIG. 2, according to another embodiment of the present invention, an ammunition sealing system 10A includes a case hanging rail 12A for holding a row of ammunition cases 14A facing downwards and one or more induction heating elements 18A positioned in close proximity to the row of cases 14A. In this case, the ammunition case sealing system 10A can be used after a projectile 24A is attached to a case mouth 16A. Specifically, after sealant is dispensed inside the case mouths 16A, respective projectiles 24A are placed in the case mouths 16A. One or more heating elements 18A are then used to heat the liquid sealant, thereby sealing the projectiles 24A to the respective ammunition cases 14A. One or more heating elements 18A can further include a temperature sensor 24 and the heating temperature can be adjusted to a desired heating temperature.

Similar to FIG. 1, the case hanging rail 12A can be configured to move a row of ammunition cases 14A along one direction of the rail 12A (e.g., from a first rail end 20A to a second rail end 22A or from the second rail end 22A to the first rail end 20A) or in both directions (e.g., from a first rail end 20A to a second rail end 22A and from the second rail end 22A to the first rail end 20A), so that each case in a row of cases 14A will pass through the heating element 18A at a desired speed to dry the sealant. Alternatively, the one or more heating elements 18A can be configured to move along one direction or both directions along the rail 12A at a desired speed to dry the row of cases 14A held by the case hanging rail 12A.

Figure 3:
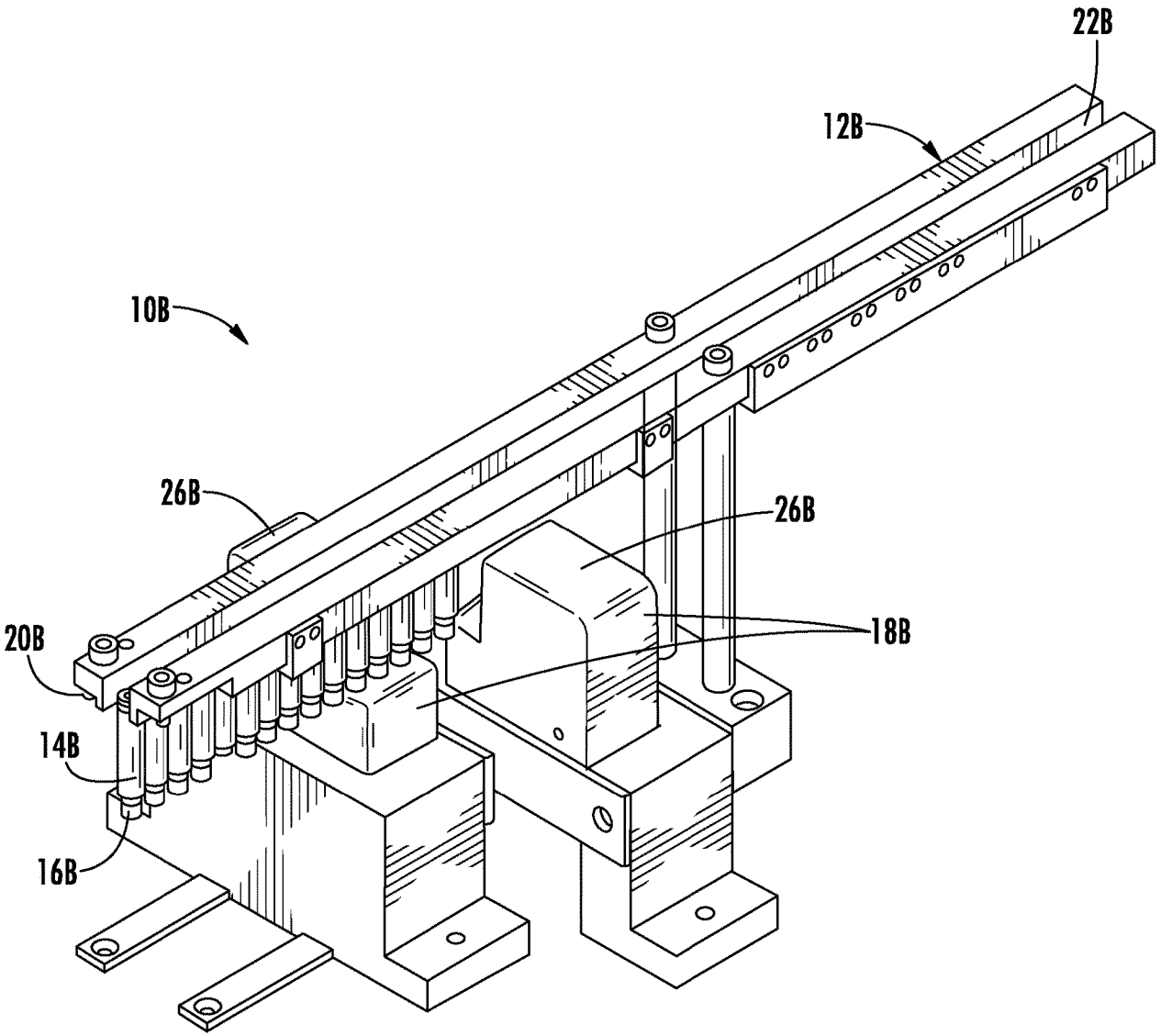
FIG. 3 is a perspective view of an ammunition case mouth sealing system, according to another embodiment of the present invention.

Referring to FIG. 3, an ammunition sealing system 10B includes a case hanging rail 12B for holding a row of cases 14B with case mouth 16B facing downwards and one or more heating elements 18B positioned in close proximity to the row of cases 14B. After the sealant is dispensed inside the case mouths 16B, the one or more heating elements 18B can be used to heat the liquid sealant before or after projectiles are received into the case mouths 16B.

In this scenario, the one or more heating elements 18B are one or more microwave heating elements. The one or more microwave heating elements 18B include a microwave generator for launching microwaves at an appropriate frequency (above 100 MHz) and the microwaves are guided through space to the ammunition cases 14B for heating. In other words, the ammunition cases 14B to be heated are placed in the path of the microwaves for heating without direct contact. The one or more microwave heating elements 18B are preferred for ammunition cases made of a polymer material or microwave-safe metals. The one or more heating elements 18B can further include a temperature sensor and controller 26B to adjust the heating temperature to a desired value. The temperature sensor and controller 26B can adjust the heating temperature by adjusting power level of the microwave generator.

The ammunition sealing system 10B can also be used to dry sealant dispensed around a case mouth 16B after a projectile (not shown) is received therein. In this case, the projectile is preferably made of polymer materials.

Similar to FIGS. 1 and 2, the case hanging rail 12B can be configured to move the row of ammunition cases 14B along one direction of the rail 12B (e.g., from a first rail end 20B to a second rail end 22B) or both directions (e.g., from the first rail end 20B to the second rail end 22B and from the second rail end 22B to the first rail end 20B) such that each case 14B will pass through the heating element 16B at a certain speed for drying the sealant. Alternatively, the one or more microwave heating elements 18B can be configured to move along the direction of the rail 12B at a certain speed to dry the row of ammunition cases 14B section by section. The speed of movement of the row of ammunition cases 14B can affect the heating temperature and therefore the drying time.

Figure 4:
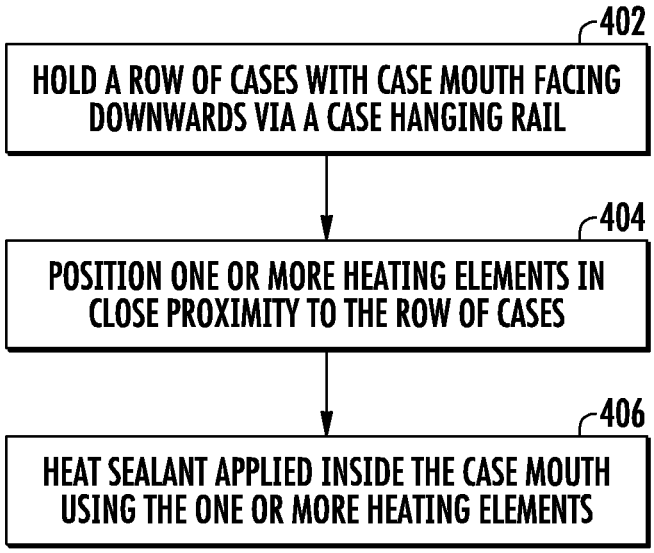
FIG. 4 is a flowchart illustrating a method of drying sealant inside an ammunition case mouth, according to another embodiment of the present invention.

Referring to FIG. 4, according to one embodiment of the present invention, a method of drying liquid sealant applied inside a mouth of an ammunition case in an ammunition assembly process comprises, at step 402, using a case hanging rail (e.g., case hanging rail 12) to hold a row of ammunition cases (e.g., cases 14), for example, with the case mouths (e.g., case mouths 16) facing downwards. At step 404, one or more heating elements are positioned in close proximity to the row of cases. At step 406, liquid sealant applied inside the case mouth is heated by one or more heating elements (e.g., one or more heating elements 18). The one or more heating elements can be one or more induction heating elements or one or more microwave heating elements.

The one or more heating elements disclosed by the present invention can heat sealant dispensed at the mouth of the ammunition cases in a more controlled and efficient manner. The method also eliminates the high level of audible noise generated by current methods. The heating element also occupies less space than current heating methods.

The ammunition sealing system 10, 10A and 10B can be made as an independent machine or incorporated into an ammunition manufacturing line. In the latter case, the one or more heating elements 18, 18A or 18B are positioned in close proximity to the case mouth of the ammunition to heat sealant when the sealant needs to be heated and removed when the sealant is dried.

In general, the foregoing description is provided for exemplary and illustrative purposes; the present invention is not necessarily limited thereto. Rather, those skilled in the art will appreciate that additional modifications, as well as adaptations for particular circumstances, will fall within the scope of the invention as herein shown and described.

What is claimed is:

1. An ammunition sealing system comprising:

a case hanging rail for holding a row of cases;

one or more heating elements positioned in close proximity to the row of cases;

wherein the one or more heating elements is configured to heat sealant applied inside the case mouth; and wherein the one or more heating elements are one or more induction heating elements or microwave heating elements.

2. The ammunition sealing system of claim 1, wherein the row of cases is held with the case mouth facing downwards.

3. The ammunition sealing system of claim 1, wherein the sealant is applied before a projectile is received into the case mouth.

4. The ammunition sealing system of claim 1, wherein the sealant is applied after a projectile is received into the case mouth.

5. The ammunition sealing system of claim 1, wherein the one or more heating elements includes two induction heating elements positioned in close proximity to both sides of the row of cases.

6. The ammunition sealing system of claim 1, wherein the one or more heating elements include a temperature controller to adjust the heating temperature to a desired temperature.

7. The ammunition sealing system of claim 1, wherein the case hanging rail is configured to move the row ammunition cases along at least one direction of the rail.

8. The ammunition sealing system of claim 7, wherein the case hanging rail is configured to move the ammunition cases at a certain speed.

9. The ammunition sealing system of claim 1, wherein the one or more heating elements are configured to move along the case hanging rail along at least one direction of the rail.

10. The ammunition sealing system of claim 1, wherein the one or more heating elements are located underneath the case mouth of the row of ammunition cases.

11. The ammunition sealing system of claim 1, wherein the one or more heating elements are configured to be removed when the sealant is dried.

* * * * *